US005586500A

United States Patent [19]

Takami et al.

[11] Patent Number: 5,586,500

[45] **Date of Patent: *Dec. 24, 1996**

[54] STENCIL STAMP

[75] Inventors: Hiroshi Takami; Yoshihiro Yasui; Takashi Okumura, all of Nagoya, Japan

[73] Assignee: Brother Kogyo Kabushiki Kaisha, Nagoya, Japan

[ * ] Notice: The term of this patent shall not extend beyond the expiration date of Pat. No. 5,483,880.

[21] Appl. No.: 401,688

[22] Filed: Mar. 10, 1995

[30] Foreign Application Priority Data

May 19, 1994 [JP] Japan ..... 6-105222

[51] Int. Cl.[6] ..... B41F 31/00

[52] U.S. Cl. ..... 101/327; 101/125

[58] Field of Search ..... 101/327, 112, 101/373, 398, 45, 125

[56] References Cited

U.S. PATENT DOCUMENTS

| | | | |
|---|---|---|---|
| 3,227,079 | 1/1966 | Muskin | 101/327 |
| 3,277,819 | 10/1966 | Berkland | 101/125 |
| 3,478,682 | 10/1969 | Funashi | 101/368 |
| 3,631,799 | 1/1972 | Funahashi | 101/327 |
| 3,814,012 | 6/1974 | Derc | 101/398 |
| 4,996,921 | 3/1991 | Hong | 101/327 |
| 5,115,729 | 5/1992 | Beckman et al. | 101/327 |
| 5,184,549 | 2/1993 | Immamaki et al. | 101/128.21 |
| 5,205,214 | 4/1993 | Seo et al. | 101/327 |
| 5,454,315 | 10/1995 | Lee | 101/401.1 |
| 5,471,930 | 12/1995 | Wood | 101/405 |
| 5,483,880 | 1/1996 | Seo et al. | 101/125 |

FOREIGN PATENT DOCUMENTS

| | | | |
|---|---|---|---|
| 0655343 | 5/1995 | European Pat. Off. . | |
| 2595986 | 9/1987 | France . | |
| 5-74833 | 3/1993 | Japan . | |
| 406166254 | 6/1994 | Japan | 101/327 |
| 7-149031 | 6/1995 | Japan . | |
| 7-314872 | 12/1995 | Japan . | |
| 1348772 | 3/1974 | United Kingdom . | |

*Primary Examiner*—Edgar S. Burr
*Assistant Examiner*—Anthony H. Nguyen
*Attorney, Agent, or Firm*—Oliff & Berridge

[57] ABSTRACT

A stencil stamp is provided with a plurality of individually replaceable stencil stamp blocks. The stencil stamp is capable of stamping a multicolor pattern by a single stamping action. The stencil stamp comprises a handgrip to be gripped by the user's hand, a stamping unit, which is fixedly held by a stencil stamp block holding member on the handgrip, and a skirt, which covers the stamping unit for protection. The stamping unit comprises a plurality of stencil stamp blocks, each having a stamping part for forming a particular pattern. The plurality of stencil stamp blocks may be provided with ink-bearing members impregnated with inks of different colors to enable multicolor stamping by a single stamping action. The stencil stamp blocks can be individually removed from the stencil stamp block holding member, and can be used in desired combinations to create different patterns.

20 Claims, 9 Drawing Sheets

STENCIL STAMP

BACKGROUND OF THE INVENTION

1. Field of the Invention

The present invention relates to a stencil stamp assembly, and more particularly, to a stencil stamp assembly provided with a thermal stencil sheet forming a stamping part.

2. Description of Related Art

Stamps provided with a rubber stamping member have been used for stamping the surface of a sheet with company names, addresses and the like in character strings. Generally, stamps for such uses are made individually to order. As a result, the stamps are relatively expensive, and it requires a relatively long time to procure a stamp after placing an order.

A thermal stencil sheet has been practically used on stamp assemblies in place of the rubber stamping member. Pores, or holes, can be formed in a desired pattern in the thermal stencil sheet by irradiating the thermal stencil sheet with an infrared beam or by using a thermal head. Various patterns including character strings, figures, marks and such may be formed on a recording sheet by pressing ink out through the pores of the thermal stencil sheet onto the recording sheet.

A stencil stamp assembly comprising, as principal components, the aforesaid thermal stencil sheet and an ink-bearing member impregnated with ink is disclosed in Japanese Utility Model Laid-Open Publication No. 5-74833. The stencil stamp assembly is suitable for replacing a stamp provided with a rubber stamping member as a stamping part.

The prior art stencil stamp assembly includes a stencil stamp block fabricated by attaching an ink-bearing member impregnated with ink to a frame that surrounds the ink-bearing member, then adhesively attaching a thermal stencil sheet to the frame so that the thermal stencil sheet covers the ink-bearing member.

When using the stencil stamp block on a stencil stamp assembly, the stencil stamp block is adhesively attached to a cushion member on a lower surface of the base of a handgrip on the stamp assembly. Character strings or the like are formed in a desired pattern in the thermal stencil sheet with infrared beams or a thermal head. The resulting stamp assembly is capable of stamping many copies of the desired pattern on a recording sheet. The stamp assembly provided with this stencil stamp block will hereinafter be referred to as a "stencil stamp."

The prior art stencil stamp, which has a thermal stencil sheet placed over the lower surface of the ink-bearing member, has a unitary stamping part, and the stencil stamp block is formed in a single unit. Accordingly, a user may encounter the following inconveniences when using the prior art stencil stamp.

If the stamping part of the stencil stamp is partly broken, the entire stencil stamp becomes inoperable, even if the other components of the stencil stamp remain operable. The entire stencil stamp block of the stencil stamp must be replaced with a new stencil stamp block to restore the stencil stamp to its normal state.

If a portion of the pattern of pores formed in the stamping part of the thermal stencil sheet of the stencil stamp must be changed, the entire stencil stamp block must be replaced with another stencil stamp block having a stencil sheet with the desired pattern of pores, even if portions of the original stencil sheet need not be changed. This is necessary because once the pattern of pores is formed in a thermal stencil sheet, the pattern cannot be changed.

Because the stencil stamp block has only a single ink-bearing member impregnated with ink of a single color, a multicolor image cannot be created by a single stamping action.

When it is desirable to stamp only a portion of the pattern formed in the stencil sheet of the stamping part, the undesired portions of the stamping part must be masked with a separate piece of paper or the like, which is troublesome.

SUMMARY OF THE INVENTION

An object of the present invention is to provide a stencil stamp employing a thermal stencil sheet and having a stamping unit comprised of a plurality of stencil stamp blocks. With a stencil stamp embodying the invention, a stencil stamp block comprising a portion of the entire stamping part may be replaced when it is broken, or when it is desirable to change a portion of a pattern formed by the stamping part. The stencil stamp is capable of stamping a multicolor pattern on a recording sheet by a single stamping action because each stencil stamp block may have a different color ink. The stencil stamp is also capable of stamping a pattern on a recording sheet using only a portion of the stamping part. In addition, stencil stamp blocks may be interchanged between stencil stamps to form different combinations of characters and symbols.

A stencil stamp embodying the present invention includes a holder having a handgrip to be gripped by a user's hand, and a stamping unit attached to the holder and having a plurality of stencil stamp blocks. The plurality of stencil stamp blocks are detachably held on the holder so as to be replaceable. Each of the plurality of stencil stamp blocks comprises a base member, an ink-bearing member fixedly placed on the lower surface of the base member, and a thermal stencil sheet forming a stamping part and covering at least the lower surface of the ink-bearing member.

After pores are formed in desired patterns in the thermal stencil sheets of the stamping parts of a stencil stamp, the stencil stamp is held by the handgrip and the stamping parts are pressed against the surface of a recording sheet. Ink from ink-bearing member of the stencil stamp blocks is pressed out through the pores of the thermal stencil sheets onto the surface of the recording sheet to form a pattern on the recording sheet.

Because the stencil stamp includes a plurality of stencil stamp blocks, and each of the stencil stamp blocks is detachably held on the holder so as to be replaceable, if a thermal stencil sheet of a stencil stamp block is broken, or if it is desirable to change the pattern formed by the stencil stamp, only the relevant stencil stamp block needs to be replaced with another stencil stamp block. Because only the stencil stamp blocks that are broken need to be replaced, the repair costs are greatly reduced.

When it is desirable to stamp only the patterns formed on some of the stencil stamp blocks, one or more stencil stamp blocks may be removed from the stencil stamp so that only the desired pattern is stamped on a recording sheet. Each of the plurality of stencil stamp blocks can be used on any stencil stamp having the appropriate size and a shape. This allows stencil stamp blocks to be interchanged between stencil stamps to create new patterns. This also eliminates the need to create an entirely new stencil stamp block having the desired new pattern. Thus, varieties of patterns can be stamped by using available stencil stamp blocks in the appropriate combination.

Because the ink-bearing members of different stencil stamp blocks can be impregnated with different color inks, a multicolor pattern can be stamped by a single stamping action. In addition, because the ink-bearing members of the stencil stamp blocks of a stencil stamp are capable of holding a large quantity of ink, ink can be supplied properly for a great many stamping cycles.

The stencil stamp block holding member of the stencil stamp, which surrounds the periphery of a thermal stencil sheet and the outer circumference of a base member of a stencil stamp block, prevents the effluence of ink through the periphery of the thermal stencil sheet and holds the stencil stamp blocks firmly to prevent the dislocation of the stencil stamp blocks during stamping.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 1:
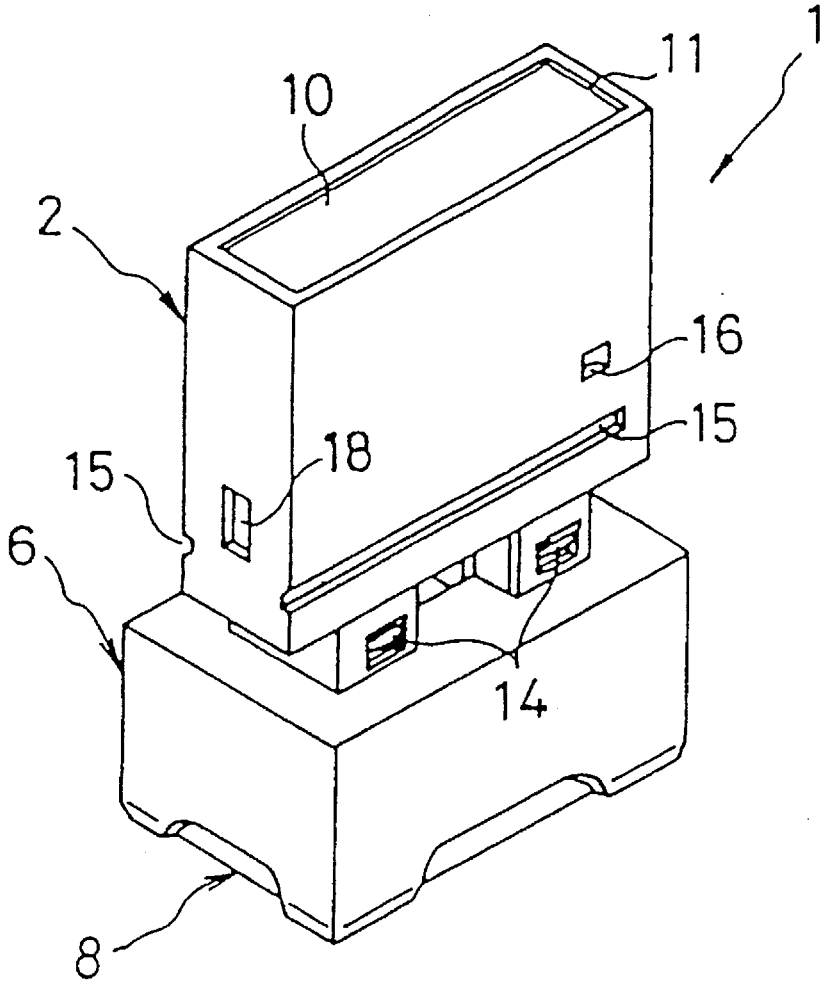
FIG. 1 is a perspective view of a stencil stamp embodying the present invention.

Preferred embodiments of the present invention will be described hereinafter with reference to FIGS. 1–11.

As shown in FIGS. 1 to 4, a stencil stamp 1 comprises a handgrip 2 to be gripped by the hand of a user, a stencil stamp block holding member 5 which is connected to the handgrip 2, a stamping unit 4 which is inserted in the stencil stamp block holding member 5, a skirt 6 which covers the stamping unit 4, and a protective cap 8 which is detachably held on the stamping unit 4. The handgrip 2 and the stencil stamp block holding member 5 form a holder.

The handgrip 2 is a hollow, rectangular parallelepipedic structure formed of a metal or a synthetic resin and having an open lower end. A recess 11 is formed in the upper wall 19 of the handgrip 2. A label 10 may be attached to the bottom surface of the recess 11. Two pairs of hooks 14 project downward from the lower ends of both the front wall 12 and the back wall 13. Guide grooves 15 are formed in the surfaces of the lower portions of the front wall 12 and the back wall 13, respectively. An engagement recess 16 is formed in the front wall 12, and an engagement hole 18 is formed in the left side wall 17. A spring support 20 is formed in the central portion of the lower surface of the upper wall 19 of the handgrip 2.

The stamping unit 4 is provided with a first stencil stamp block 7A and a second stencil stamp block 7B. The second stencil stamp block 7B is half the size of the first stencil stamp block 7A. The stamping unit 4 is inserted in the stencil stamp block holding member 5 from below, and is fixed in place within the stencil stamp block holding member 5 so that about the top two-thirds of the stamping unit 4 is covered with the stencil stamp block holding member 5. The four hooks 14 of the handgrip 2 engage with four apertures 37 on the stencil stamp block holding member 5 to fixedly hold the stencil stamp block holding member 5.

Because the first and second stencil stamp blocks 7A and 7B are identical in all respects except for size, and the pattern they are designed to create, references to a stencil stamp block will be indicated simply by the reference number 7 hereinafter, except when it is necessary to specify the stencil stamp blocks 7A and 7B individually. The stencil stamp blocks 7 are fixedly held in the stencil stamp block holding member 5 by an adhesive layer 38 formed on the lower surface of the upper wall 35 of the stencil stamp block holding member 5. The stencil stamp blocks 7 can be removed from the stencil stamp block holding member 5 by pushing the stencil stamp blocks 7 with a finger, or the like, through an opening 39 formed in the upper wall 35 of the stencil stamp block holding member 5.

Figure 5:
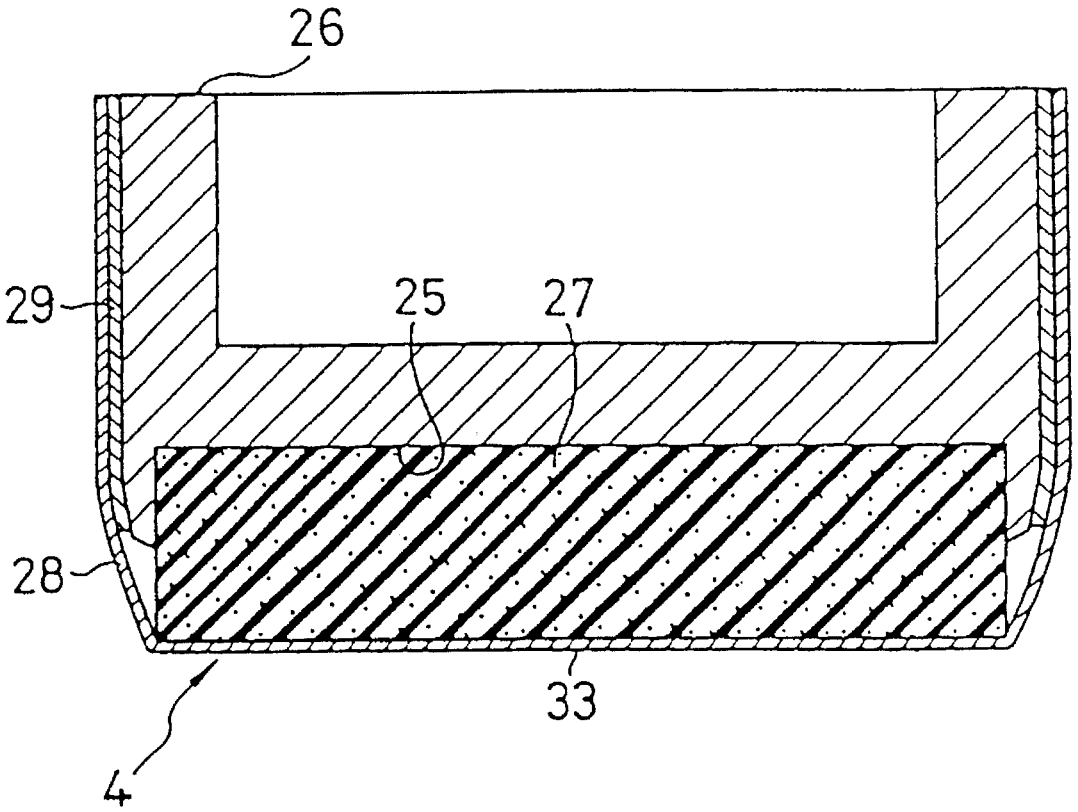
FIG. 5 is an enlarged longitudinal sectional front view of a stamping unit of a stencil stamp embodying the invention.

As shown in FIG. 5, each of the stencil stamp blocks 7 comprise a base member 26 having a hollow, rectangular parallelepipedic shape. The base member 26 may be formed of a synthetic resin. The base member 26 has a shallow recess 25, formed on its bottom surface. An ink-bearing member 27 is fitted in the recess 25, and a thermal stencil sheet 28 covers the lower surface of the ink-bearing member 27 and the outer circumference of the base member 26. The thermal stencil sheet 28 is adhesively attached to the outer circumference of the base member 26 with an adhesive 29. The ink-bearing member 27 may be attached adhesively to the bottom surface of the recess 25 of the base member 26 with an adhesive or the like.

Because the base member 26 is wetted with ink from the ink-bearing member 27, the base member 26 may be formed of a metal or a synthetic resin having an excellent resistance to the ink, such as vinyl chloride, polypropylene, polyethylene, polyacetal or polyethylene terephthalate. The recess 25 of the base member 26 containing the ink-bearing member 27 prevents dislocation of the ink-bearing member 27 and the effluence of ink from the ink-bearing member 27.

The ink-bearing member 27 may be an elastic foam pad of a synthetic resin, such as polyethylene, polypropylene, polyethylene terephthalate, polyurethane, acrylonitrile-butadiene rubber or the like, or a non-woven fabric.

A stencil stamp provided with first and second stencil stamp blocks 7A and 7B may have a first ink-bearing member 27 of the stencil stamp block 7A saturated with a black ink and a second ink-bearing member 27 of the stencil stamp block 7B saturated with a red ink. When pressure is applied to the ink-bearing members 27, the ink oozes out of the ink-bearing members 27, and through pores in the thermal stencil sheets 28 to form a multicolored image on a recording sheet.

Figure 6:
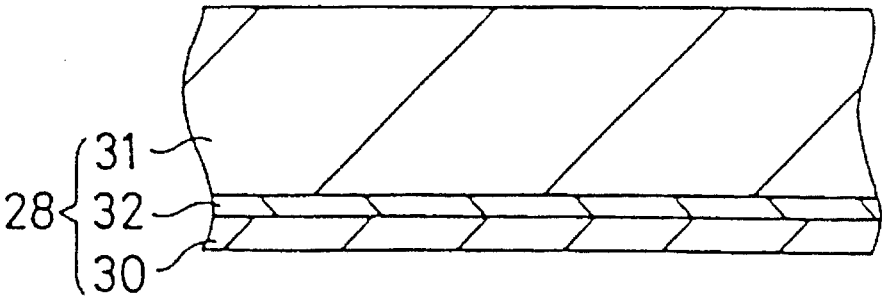
FIG. 6 is an enlarged sectional view of a thermal stencil sheet of a stencil stamp embodying the invention.

As shown in FIG. 6, the thermal stencil sheet 28 comprises a thermoplastic film 30, a porous foundation 31 and an adhesive layer 32 adhesively connecting the thermoplastic film 30 to the porous foundation 31. The thermoplastic film 31 may be a film of a thermoplastic synthetic resin, such as polyethylene terephthalate, polypropylene, a copolymer of vinylidene chloride and vinyl chloride or the like. The film 31 may have a thickness in the range of approximately 1 to 4 μm, preferably a thickness of approximately 2 μm.

Thermoplastic films having a thickness of less than 1 μm are costly, have a comparatively low strength, and hence are not practical. Thermoplastic films having a thickness greater than 4 μm are excessively thick, and pores cannot be formed therein with an ordinary thermal head which has a rated output capacity in the range of 50 to 300 $mJ/mm^2$.

The porous foundation 31 may be comprised of a tissue paper of a textile material containing, as its principal material, natural fiber, such as Manila hemp fiber, paper mulberry fiber or mitsumata plant fiber. The porous foundation 31 may also be formed of a synthetic fiber such as polyethylene terephthalate fiber, polyvinyl alcohol fiber, polyacrylonitrile fiber, or a semi-synthetic fiber such as rayon fiber.

Figure 7:
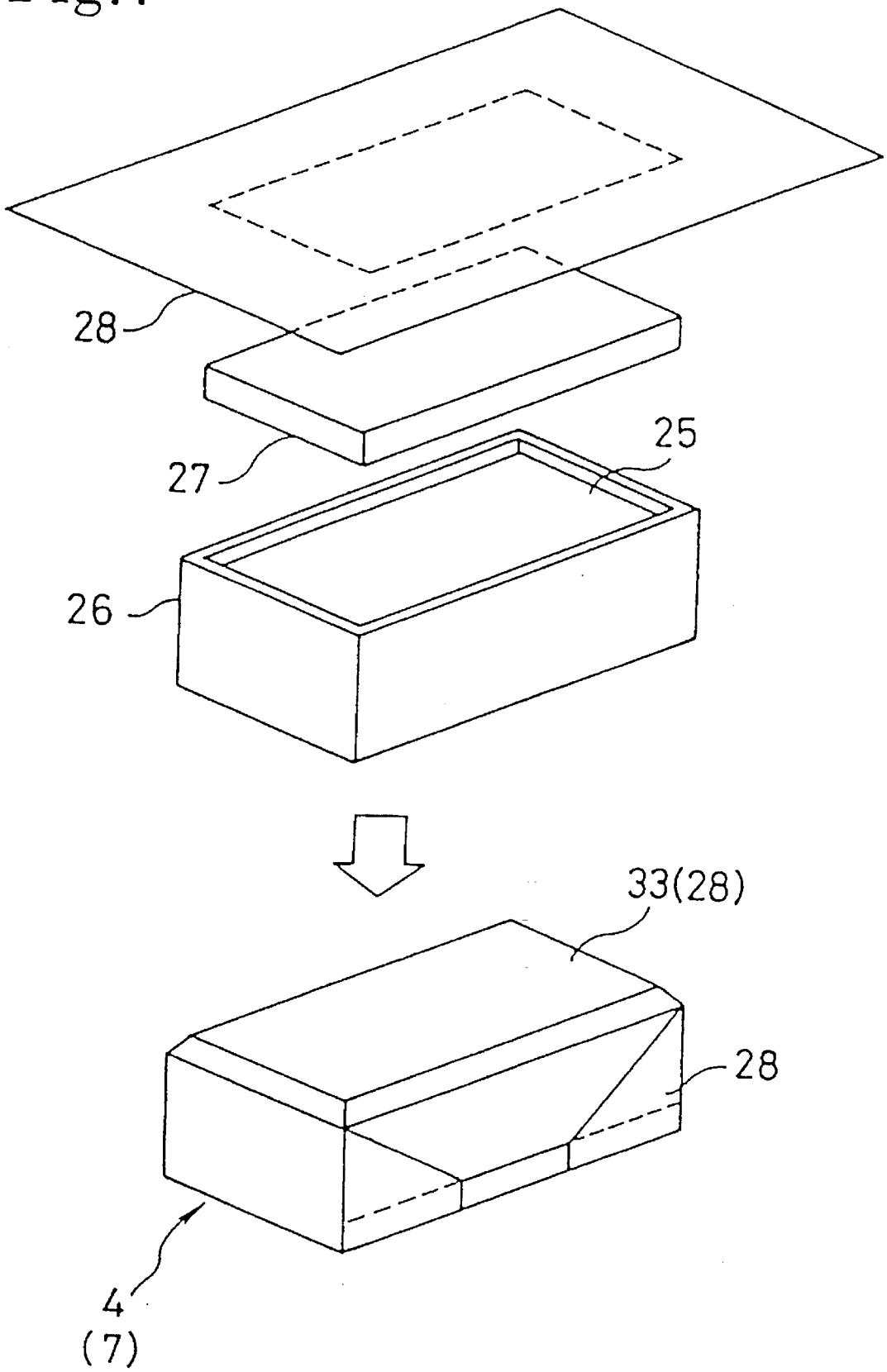
FIG. 7 is an exploded perspective view of a stencil stamp block.

As shown in FIGS. 5–7, to assemble a stencil stamp block, the base member 26 is set in an inverted position, and the ink-bearing member 27 is placed in the recess 25. The ink-bearing member 27 is then impregnated with ink. Next, the thermal stencil sheet 28 is placed over the base member 26, with the porous foundation 31 thereof in close contact with the ink pad 27. The periphery of the thermal stencil sheet 28 is folded so as to be in close contact with the side surfaces of the base member 26, and the periphery of the thermal stencil sheet 28 is adhesively attached to the base member 26 with an adhesive layer 29.

The portion of the thermal stencil sheet 28 in close contact with the lower surface of the ink-bearing member 27 forms a stamping part 33. Because the periphery of the thermal stencil sheet 28 is adhesively attached to the side surfaces of the base member 26, as mentioned above, the stamping part 33 extends over substantially the entire lower surface of the stencil stamp block 7, which simplifies positioning during stamping.

The adhesive layer 29 for adhesively attaching the periphery of the thermal stencil sheet 28 to the side surfaces of the base member 26 may be formed beforehand on the periphery of the thermal stencil sheet 28, or the adhesive layer 29 may be formed on both the periphery of the thermal stencil sheet 28 and the side surfaces of the base member 26.

Figure 2:
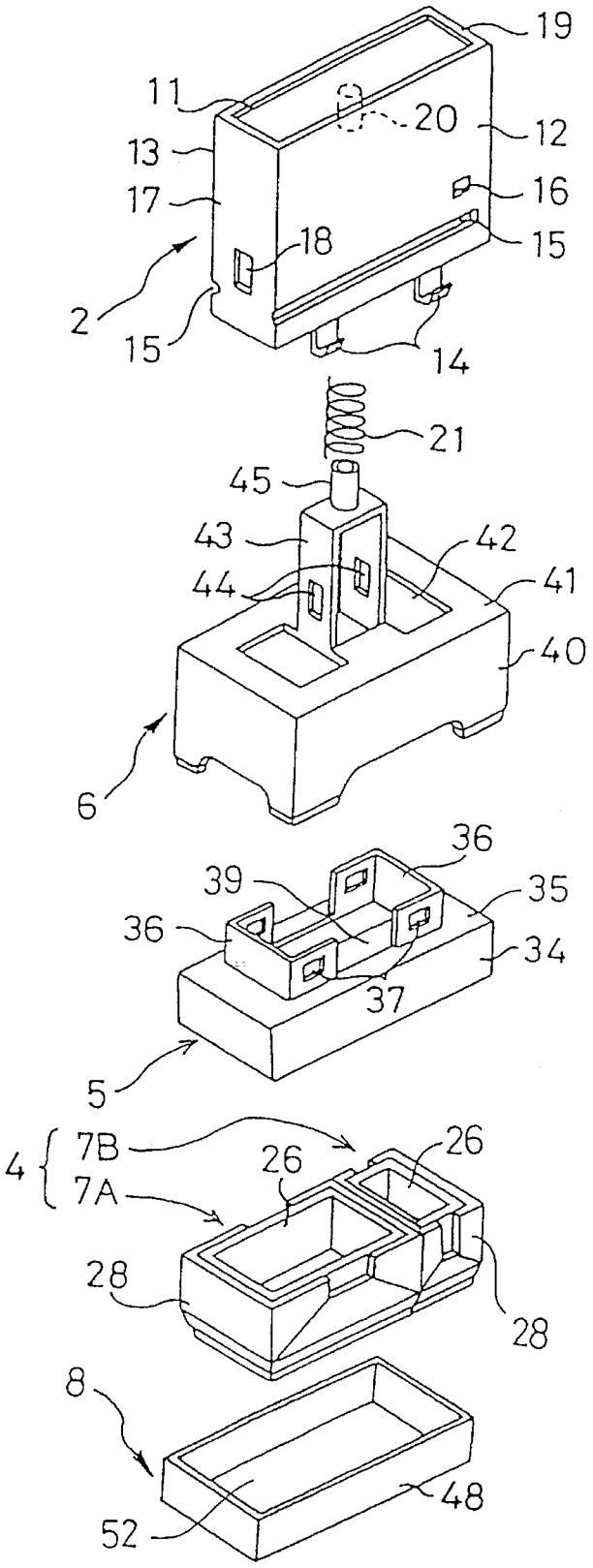
FIG. 2 is an exploded perspective view of the stencil stamp of FIG. 1.
Figure 3:
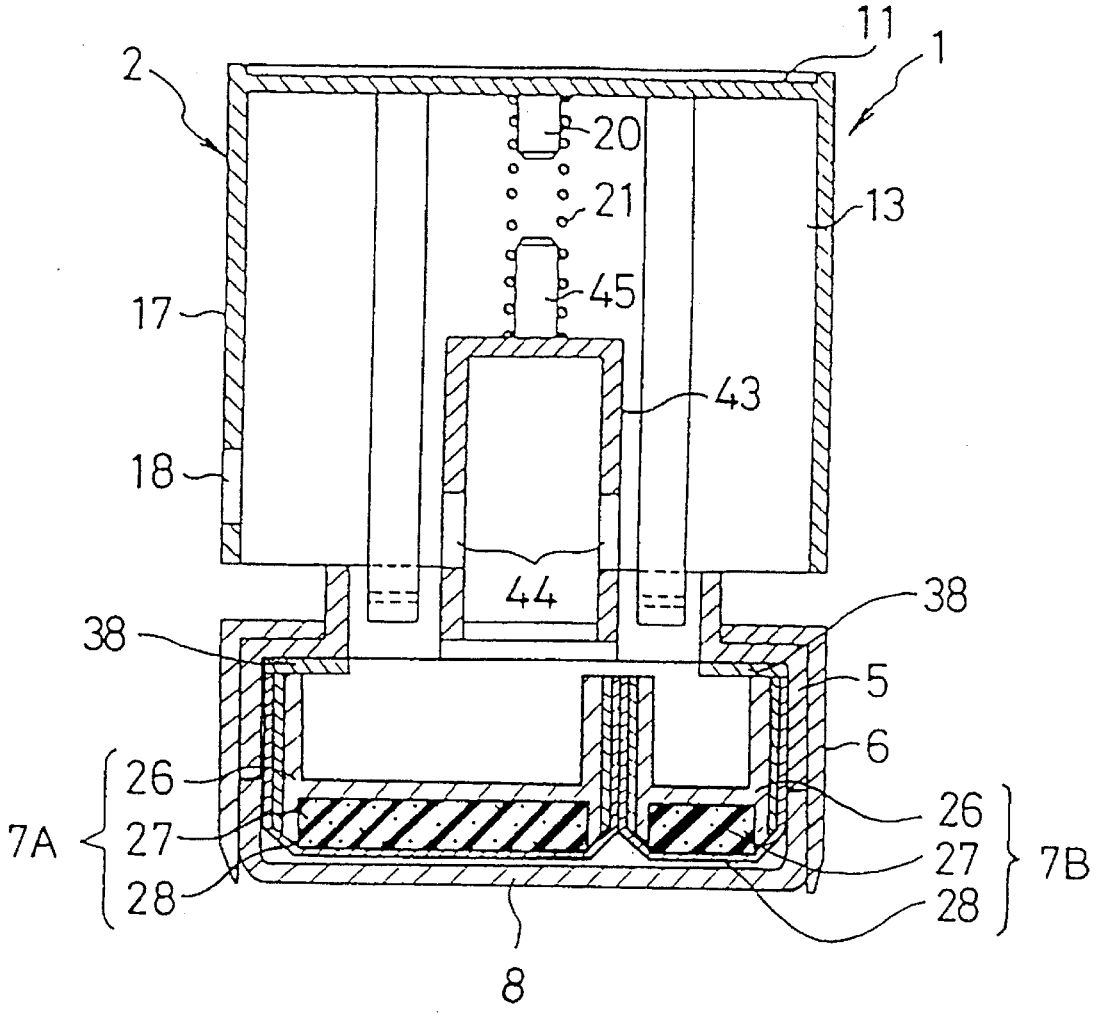
FIG. 3 is a longitudinal sectional front view of the stencil stamp of FIG. 1.
Figure 4:
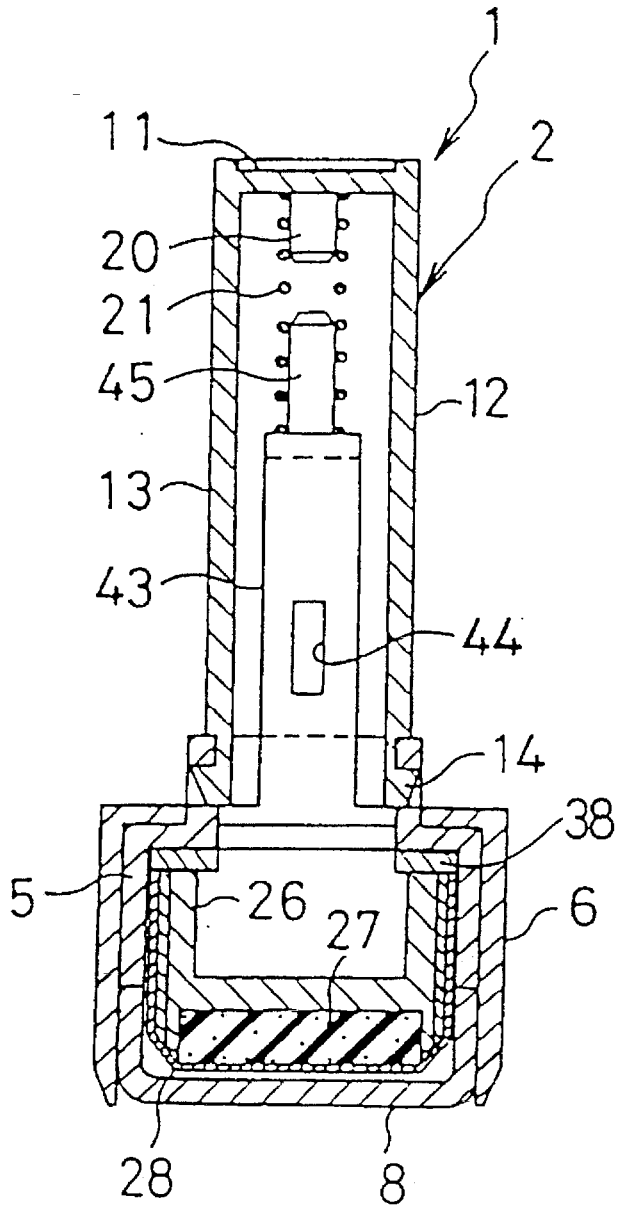
FIG. 4 is a longitudinal sectional side view of the stencil stamp of FIG. 1.

Referring to FIGS. 2 to 4, the stencil stamp block holding member 5 has side walls 34 forming a rectangular frame. The side walls 34 form a mounting depression, as seen in FIG. 3. The stamping unit 4 is attached to the lower surface of an upper wall 35 of the stencil stamp block holding member 5 with an adhesive layer 38. A pair of engagement walls 36 of a predetermined height are formed on the upper wall 35. The pair of engagement walls 36 are provided with engagement holes 37, for engaging the four hooks 14 of the handgrip 2. The pair of engagement walls 36 are inserted through a pair of rectangular holes 42 formed in an upper wall 41 of the skirt 6. The four hooks 14 are then brought into engagement with the four engagement holes 37 of the engagement walls 36 to connect the stencil stamp block holding member 5 fixedly to the handgrip 2.

The stencil stamp block holding member 5 is capable of holding the first and second stencil stamp blocks 7A and 7B, or three stencil stamp having a size like the second stencil stamp block 7B.

Referring to FIGS. 2 to 4, the skirt 6 has side walls 40 forming a rectangular frame for receiving the side walls 34 of the stencil stamp block holding member 5. An upper wall 41 of the skirt 6 extends over the upper wall 35 of the stencil stamp block holding member 5. A U-shaped stem 43 of a predetermined height projects upward from the central portion of the upper wall 41 and into the handgrip 2. A spring support 45 projects from the central portion of the upper end of the stem 43. Guide holes 44 are formed in the right and the left legs of the stem 43 at positions corresponding to the guide holes 18, in the handgrip 2.

Figure 8:
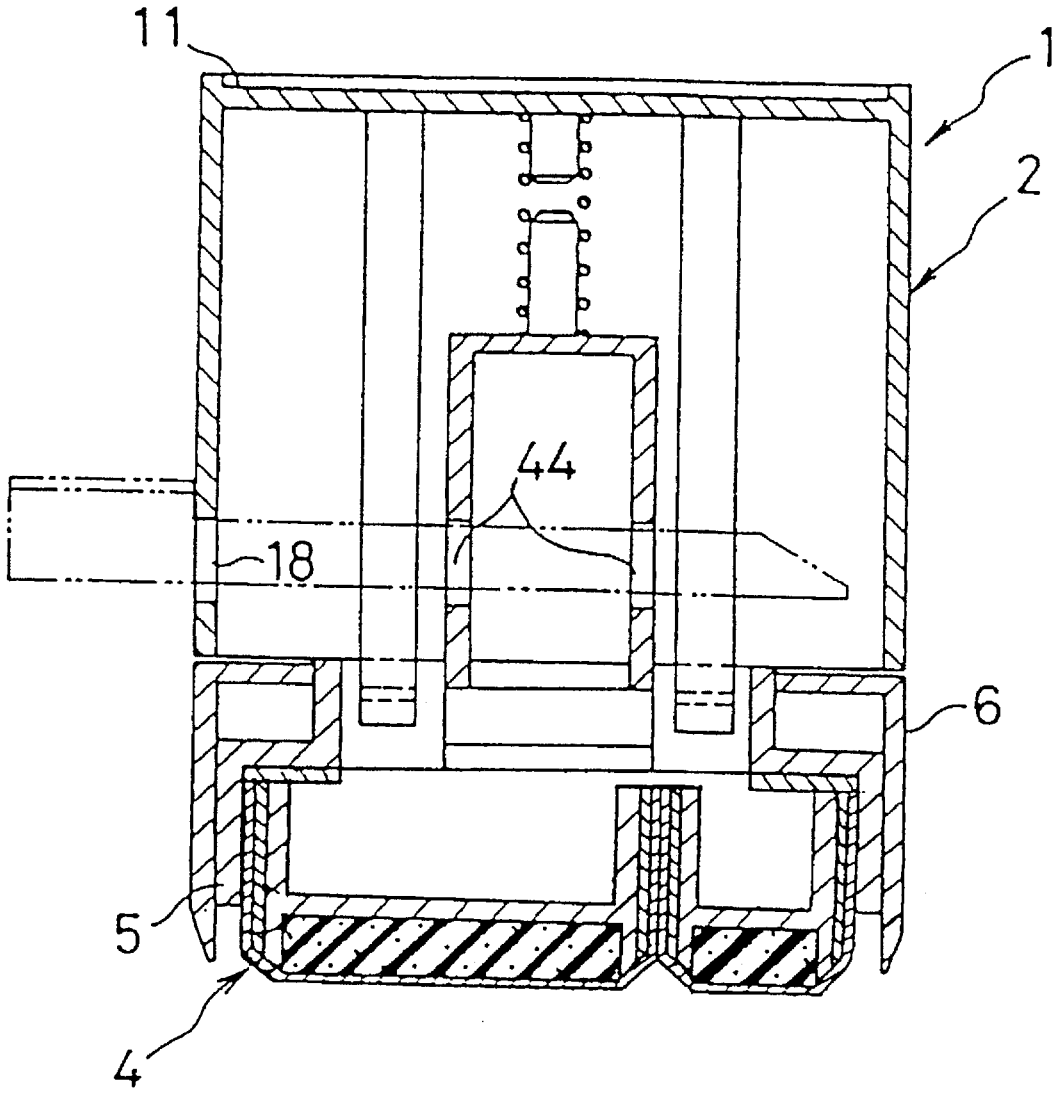
FIG. 8 is a longitudinal sectional front view of the stencil stamp showing a skirt at a third position.
Figure 9:
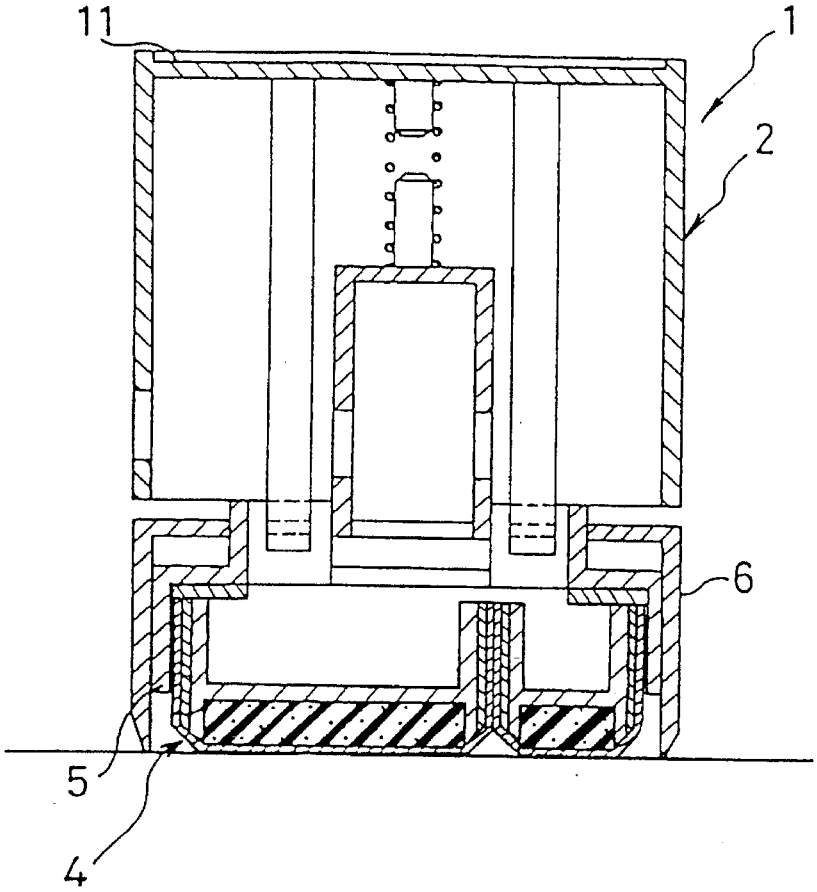
FIG. 9 is a longitudinal sectional front view of the stencil stamp showing a skirt at a second position.

A compression spring 21 extends between the spring support 20 of the handgrip 2 and the spring support 45 of the skirt 6 so as to bias the skirt downward away from the handgrip 2. The skirt 6 is vertically movable between a first position, as shown in FIGS. 3 and 4, a second position, as shown in FIG. 9, and a third position, as shown in FIG. 8. The skirt 6 is biased toward the first position by the compression spring 21. Recesses are formed in the middle portions of the lower ends of the four side walls 40 of the skirt 6, to facilitate insertion and removal of the protective cap 8, and to facilitate positioning of the stamping parts over a recording sheet.

When the skirt 6 is at the first position, the lower surface of the upper wall 41 of the skirt 6 is in contact with the upper wall 35 of the stencil stamp block holding member 5, and the lower edges of the side walls 40 of the skirt 6 are positioned below the stamping parts 33 of the stencil stamp blocks. When the skirt 6 is at the second position, the upper wall 41 of the skirt 6 is located between the upper wall 35 of the stencil stamp block holding member 5, and the lower end of the handgrip 2, and the lower edges of the side walls 41 of the skirt 6 are flush with the stamping parts 33 of the stencil stamp blocks. When the skirt 6 is at the third position, the upper wall 41 of the skirt 6 is in contact with the lower end of the handgrip 2, and the lower edges of the side walls 41 of the skirt 6 are above the stamping parts 33 of the stencil stamp blocks. Desirably, the stroke of the skirt 6 (i.e., the distance between the first position and the second position) is about 5 mm.

The protective cap 8 is detachably put over the lower end of the stamping unit 4 for protection. The shape of the side walls 48 of the protective cap 8 is the same as that of the side walls 34 of the stencil stamp block holding member 5. The protective cap 8 is snugly fitted into the side walls 40 of the skirt 6.

As shown in FIGS. 3 and 4, when the protective cap 8 is fitted in the side walls 40 of the skirt 6, the upper edges of the side walls 48 of the protective cap 8 are in contact with the lower edges of the side walls 34 of the stencil stamp block holding member 5. A small clearance exists between the bottom wall 52 of the protective cap 8, and the stamping parts 33 of the stencil stamp blocks 7A and 7B. The protective cap 8 is held in place by friction between the side walls 48 thereof and the side walls 40 of the skirt 6. The protective cap 8 will not be stained with ink, even if the handgrip 2 is depressed while the protective cap 8 is inserted in the skirt 6, because the upper edges of the side walls 48 of the protective cap 8 are in contact with the lower edges of the side walls 34 of the stencil stamp block holding member 5, thus maintaining the clearance.

Figure 10:
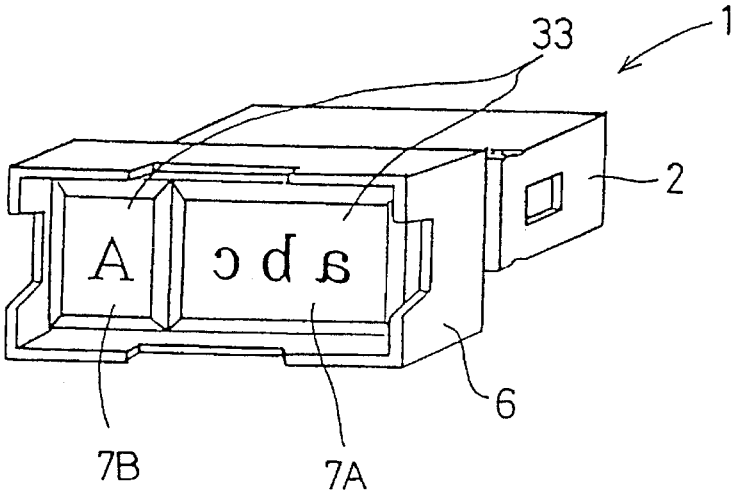
FIG. 10 is a perspective view showing patterns formed in stencil stamp blocks of a stencil stamp.

As shown in FIG. 10, pores (holes) are formed in a pattern of a character string "abc" and a pattern of a character "A" in the stamping parts 33 of the thermal stencil sheets of the stencil stamp blocks 7A and 7B, respectively. The pores may be formed with a thermal head of a thermal printer (not shown). Because ink-bearing member 27 of the stencil stamp block 7A is impregnated with black ink, and the ink-bearing member 27 of the stencil stamp block 7B is impregnated with red ink, the stencil stamp 1 is able to stamp the character string "abc" and the character "A" on a recording sheet in black and red, respectively. A stencil stamp 1 embodying the present invention, similarly to an ordinary rubber stamp provided with a rubber stamping part, is able to stamp the patterns about 1000 times.

Figure 11:
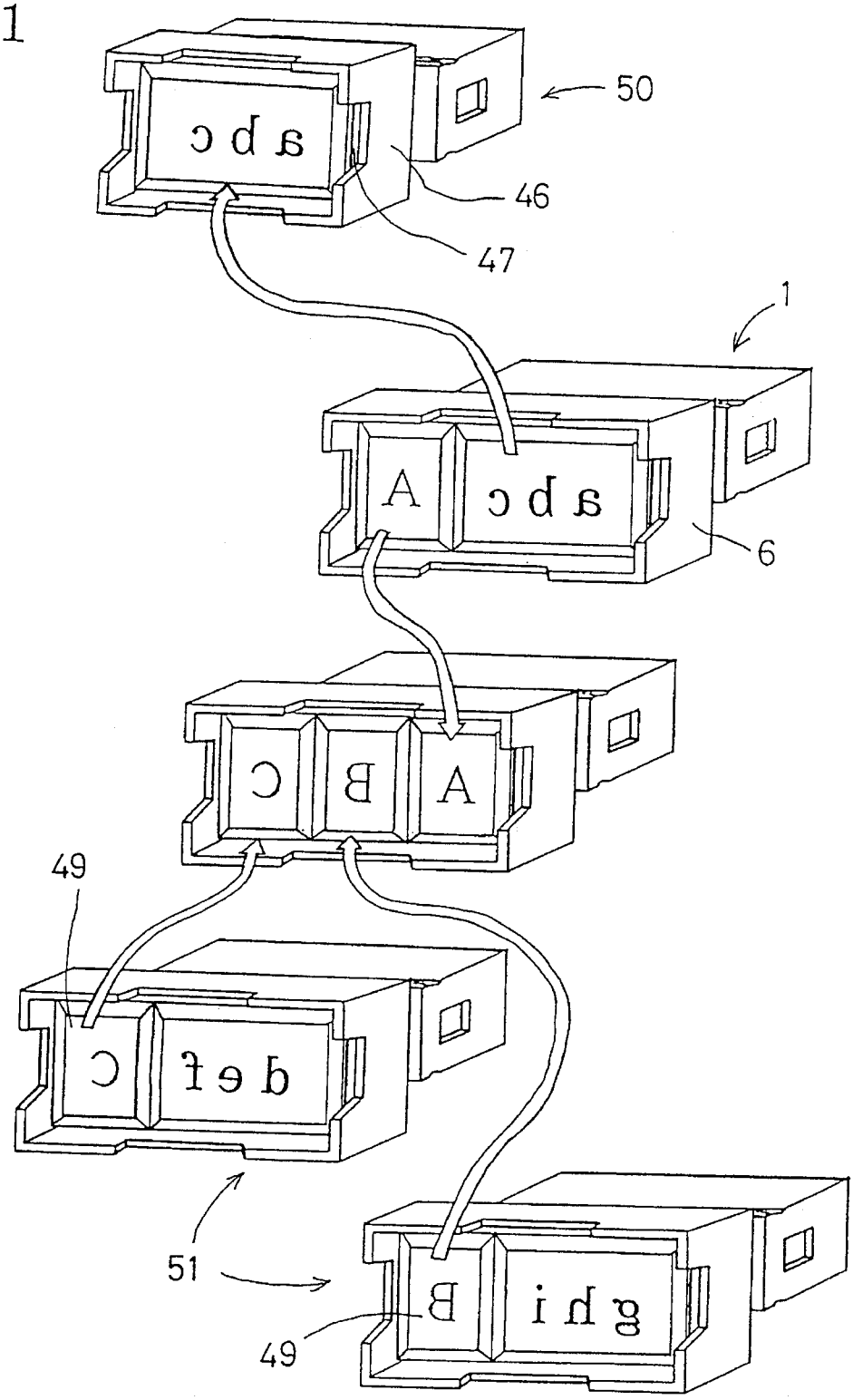
FIG. 11 is a perspective view showing different combinations of stencil stamp blocks affixed to stencil stamps.

Because the stencil stamp blocks 7 are detachably held on the stencil stamp block holding member 5. If only one of the stencil stamp blocks 7A and 7B is to be used, the other stencil stamp block may be removed from the stencil stamp block holding member 5. Furthermore, as shown in FIG. 11, each of the stencil stamp blocks 7 can be used on a similarly sized stencil stamps. The stencil stamp blocks may be interchanged and mixed to produce a stencil stamp having a desired pattern.

As will be clear to one of skill in the art, infrared radiation can also be used to form pores in the thermal stencil sheets of the stamping parts 33 instead of a thermal head. When forming pores in the stamping part 33 of the thermal stencil sheet 28, the stencil stamp 1 is set in a thermal pore forming device provided with a thermal head identical to that of a thermal printer. The pore forming device has a guide bar (indicated by alternate long and two short dashes lines in FIG. 8) which is inserted through the guide holes 18 and 44 to hold the skirt 6 at the third position.

When the stencil stamp 1 is not in use, the protective cap 8 is put over the stencil stamp blocks 7, and the skirt 6 is held at the first position by the spring 21.

To use the stencil stamp, the protective cap 8 is first removed. The stamping parts 33 are then positioned at a desired location over the surface of a recording sheet using the skirt 6 as a positioning means. Because the stencil stamp 1 can be positioned by observing the alignment of the edges of the stamping parts 33 with desired stamping positions, the stamping parts 33 can be accurately positioned. The handgrip 2 is then depressed to push the stamping parts 33 against the surface of the recording sheet. The ink-bearing members 27 are compressed between the base member 26 and the recording sheet, and ink contained in the ink-bearing members 27 is squeezed out through the pores of the thermal stencil sheets 28, and onto the surface of the recording sheet to form ink dots in the desired patterns.

When stamping patterns with the stencil stamp, the spring 21 is compressed, and the skirt 6 is moved to the second position. When the pressure applied to the handgrip 2 during stamping is removed, the spring 21 causes the skirt 6 to return to the first position, thus separating the stamping parts 33 from the recording sheet. This ensures that the patterns are clearly stamped on the recording sheet, even if the recording sheet is a very thin one. When stamping patterns in a narrow frame on the surface of a recording sheet, the patterns can be stamped with the skirt 6 held at the second position by the user's hand.

When the stencil stamp 1 is not in use, the skirt 6 is held at the first position by the spring 21, and the stencil stamp 1 is supported on the skirt 6 to protect the stamping parts 33.

Because the skirt 6 can be moved to the third position where the lower end of the skirt 6 is above the stamping parts 33, pores can be formed in desired patterns in the stencil sheet 28 of the stamping parts 33 while the skirt 6 is held at the third position.

Because the stamping unit 4 has the stencil stamp block holding member 5 surrounding the peripheries of the thermal stencil sheets 28 on the side surfaces of the base members 26, the peripheries of the thermal stencil sheets 28 will not be damaged by the rubbing action caused by the reciprocal motion of the skirt 6. In addition, the effluence of ink from the ink-bearing members 27 is prevented by the side walls of the recess 25 formed in the base member 26. Furthermore, because the stencil stamp block holding member 5 holds the stencil stamp blocks 7 firmly, accidental dislocation of the stencil stamp blocks 7 will not occur during stamping.

If the thermal stencil sheet 28 forming the stamping part 33 of one of the stencil stamp blocks is broken, only the broken stencil stamp block need be replaced with a new stencil stamp block. Accordingly, the stencil stamp 1 can be repaired at a reduced cost.

Because the stencil stamp 1 is provided with a protective cap 8 capable of covering the stamping parts 33 of the stamping unit 4, the stamping parts 33 can be protected from damage and dust when the stencil stamp 1 is not in use, and accidental stamping can be prevented.

The following modifications may be made to the foregoing embodiment.

1) Pores may be formed in the stamping parts 33 of the thermal stencil sheets 28 in patterns of various kinds of character strings, figures, marks and symbols other than those shown previously by way of example, and the patterns can be stamped in dot patterns on a sheet.

2) The height of the stencil stamp 1 may be reduced, and the handgrip 2 and the stamping unit 4 may be united. Furthermore, the skirt 6 may be vertically movable relative to the stamping unit 4.

3) One stencil stamp block may be integrally formed with the stencil stamp block holding member 5 or the handgrip 2, and another stencil stamp block 7 may be replaceable.

4) The handgrip 2 may be transversely extended relative to the stamping unit 4, instead of being vertically extended relative to the stamping unit 4.

5) When the stamping parts 33 are rectangular, the necessary function of the skirt 6 can be achieved when the skirt 6 is provided with legs at least at its four corners.

6) The shape of the stamping parts 33 of the stencil stamp 1 is not limited to a rectangular shape. The stamping parts 33 may have an elliptic shape, a circular shape, a square shape, a triangular shape, a polygonal shape or any kind of shape.

7) The stamping unit 4 may be provided with a plurality of stencil stamp blocks 7, each of which has a different shape, or the stamping unit 4 may be provided with a plurality of stencil stamp blocks of the same shape.

8) The stamping unit 4 may be provided with a plurality of stencil stamp blocks 7 arranged in a vertical row, a horizontal row or vertical and horizontal rows.

9) The color of the inks impregnated into the ink-bearing members 27 may be blue, black, red or any color. The colors of the inks impregnated into the ink-bearing members 27 may be indicated by applying a label 10 to the bottom surface of the recess 11 formed in the upper end of the handgrip 2.

10) A layer of an ink having a high viscosity and having a shape similar to that of the ink-bearing member 27 may be formed in the recess 25, instead of placing an ink-bearing member 27 in the recess 25.

11) The means for fixedly holding the stencil stamp blocks 7 of the stamping unit 4 on the stencil stamp block holding member 5 need not be limited to the adhesive layer 38. For instance, in an alternate embodiment, the stencil stamp blocks 7 may be provided with engagement hooks, and the stencil stamp block holding member 5 may be provided with engagement holes. In this alternate embodiment, stencil stamp blocks 7 and the stencil stamp block holding member 5 may be joined together by engaging the engagement hooks with the engagement holes, similarly to fixedly joining together the handgrip 2 and the stencil stamp block holding member 5 by engaging the hooks 14 with the engagement holes 37.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to those who are versed in the art.

What is claimed is:

1. A stencil stamp, comprising:

a handgrip;

a stencil stamp block holding member connectable to said handgrip; and a plurality of stencil stamp blocks, said stencil stamp block holding member having means to simultaneously detachably mount a plurality of stencil stamp blocks on said stencil stamp block holding member, each stencil stamp block comprising:

a base member, an ink-bearing member mounted on said base member, and a thermal stencil sheet having a stamping central portion, each said stamping central portion covering said ink-bearing member, the remainder of said thermal stencil sheet which surrounds said stamping central portion covering said base member, said stamping central portion having a plurality of apertures formed therein, ink from said ink-bearing member being passable through said plurality of apertures during a stamping operation to form an ink image on a recording sheet.

2. A stencil stamp according to claim 1, wherein said ink-bearing members of at least two of said plurality of stencil stamp blocks are impregnated with different color inks, respectively, so that a multi-colored ink image may be formed on a recording sheet.

3. A stencil stamp according to claim 1, wherein at least two of said plurality of stencil stamp blocks have different dimensions.

4. A stencil stamp according to claim 1, wherein at least two of said plurality of stencil stamp blocks have different shapes.

5. A stencil stamp according to claim 4, wherein a height of each of said stencil stamp blocks is approximately the same.

6. A stencil stamp according to claim 1, wherein a plurality of stencil stamp blocks are detachably mounted on said stencil stamp block holding member.

7. A stencil stamp according to claim 1, wherein said plurality of apertures are arranged in a pattern so that ink passing through said apertures during a stamping operation forms an ink image corresponding to said pattern on the recording sheet.

8. A stencil stamp according to claim 1, wherein said remainder of said thermal stencil sheet define peripheral portions that are attached to said base member.

9. A stencil stamp according to claim 8, wherein said stencil stamp block holding member includes a mounting depression, each of said stencil stamp blocks being mounted in said mounting depression such that said stamping portion of said thermal stencil sheet and a portion of said ink-bearing member protrude from said mounting depression.

10. A stencil stamp according to claim 9, further comprising a movable skirt having side walls, said skirt surrounding said stencil stamp block holding member and being movable relative to said stencil stamp block holding member between a first position and a second position, said stencil stamp block holding member protecting said thermal stencil sheets of said plurality of stencil stamp blocks from sliding contact with said side walls of said skirt when said skirt moves between said first and second positions.

11. A stencil stamp according to claim 1, wherein said at least one detachably mounted stencil stamp block is adhesively mounted on said stencil stamp block holding member.

12. A stencil stamp according to claim 1, wherein a surface of said stencil stamp block holding member has an aperture therethrough to aid removal of said at least one detachably mounted stencil stamp block.

13. A stencil stamp according to claim 1, further comprising a protective cap having peripheral walls and a bottom wall, said protective cap being detachably mountable on said stencil stamp to cover said plurality of stencil stamp blocks, a clearance being maintained between said bottom wall and said stamping portion of said plurality of stencil stamp blocks when said protective cap is mounted on said stencil stamp.

14. A stencil stamp, comprising:

gripping means for allowing a user to grip the stencil stamp;

a plurality of stencil stamp blocks; and holding means for holding any one of said plurality of stencil stamp blocks, said holding means simultaneously detachably holding the at least one stencil stamp block so that the one stencil stamp block can be replaced with another stencil stamp block, each stencil stamp block comprising:

a base member, ink supply means for supplying ink, said ink supply means being mounted on said base member, and a thermal stencil sheet having a stamping central portion, said stamping central portion covering said ink supply means, the remainder of said thermal stencil sheet which surrounds said stamping central portion covering each corresponding base member, said stamping central portion having a plurality of apertures formed therein, ink from said ink supply means being passable through said plurality of apertures during a stamping operation to form an ink image on a recording sheet.

15. A stencil stamp according to claim 14, wherein said ink supply means of at least two of said stencil stamp blocks comprise different color inks, respectively, so that a multi-colored ink image may be formed on a recording sheet.

16. A stencil stamp according to claim 14, wherein said stamping central portions of at least two of said stencil stamp blocks have different dimensions.

17. A stencil stamp according to claim 14, wherein said stamping central portions of at least two of said stencil stamp blocks have different shapes.

18. A stencil stamp according to claim 17, wherein said stamping central portions of said stencil stamp blocks are substantially planar.

19. A stencil stamp according to claim 14, wherein said holding means detachably holds a plurality of said stencil stamp blocks.

20. A stencil stamp according to claim 14, further comprising covering means for covering said plurality of stencil stamp blocks, said covering means being detachably mountable on said stencil stamp, a clearance being maintained between said covering means and said stamping portions of said plurality of stencil stamp blocks when said covering means is mounted on said stencil stamp.

* * * * *